US011611135B2

(12) United States Patent
Deleniv

(10) Patent No.: US 11,611,135 B2
(45) Date of Patent: Mar. 21, 2023

(54) WAVEGUIDE SECTION COMPRISING WAVEGUIDE TUBES WITH PLUG-IN FILTER DEVICES

(71) Applicant: Telefonaktiebolaget LM Ericsson (publ), Stockholm (SE)

(72) Inventor: Anatoli Deleniv, Mölndal (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 330 days.

(21) Appl. No.: 17/051,368

(22) PCT Filed: May 8, 2018

(86) PCT No.: PCT/EP2018/061936

§ 371 (c)(1),
(2) Date: Oct. 28, 2020

(87) PCT Pub. No.: WO2019/214816

PCT Pub. Date: Nov. 14, 2019

(65) Prior Publication Data

US 2021/0234244 A1 Jul. 29, 2021

(51) Int. Cl.

| | |
|---|---|
| ***H01P 1/207*** | (2006.01) |
| ***H01P 3/12*** | (2006.01) |
| ***H01P 1/202*** | (2006.01) |

(52) U.S. Cl.

CPC ..... *H01P 1/207* (2013.01); *H01P 1/202* (2013.01); *H01P 3/12* (2013.01)

(58) Field of Classification Search

CPC .. H01P 1/207; H01P 1/202; H01P 1/20; H01P 1/201; H01P 1/2053; H01P 1/225;
(Continued)

(56) References Cited

U.S. PATENT DOCUMENTS 2,911,333 A * 11/1959 Capen ..... H01P 1/202 333/260
2,931,992 A 4/1960 Caroselli
(Continued)

FOREIGN PATENT DOCUMENTS

| | | |
|---|---|---|
| CN | 1081790 A | 2/1994 |
| CN | 1337077 A | 2/2002 |
| KR | 101016744 B1 | 2/2011 |

OTHER PUBLICATIONS

Chinese Office Action and Search Report with English Machine Translation dated Apr. 23, 2021 for Patent Application No. 201880092850.5, consisting of 12-pages.
(Continued)

*Primary Examiner* — Stephen E. Jones
(74) *Attorney, Agent, or Firm* — Christopher & Weisberg, P.A.

(57) ABSTRACT

The present disclosure relates to a waveguide section having at least one air-filled waveguide conducting tube having an electrically conducting inner wall. Each waveguide conducting tube comprises has a plug-in filter device with two or more electrically conducting elements arranged in series and spaced apart by a connecting arrangement. Each plug-in filter device is adapted to be retained in the corresponding waveguide conducting tube using a dielectric holding arrangement such that the electrically conducting elements are spaced apart from the waveguide conducting tube. The electrically conducting elements are arranged to be electromagnetically coupled such that passing a radio frequency is electromagnetically filtered.

20 Claims, 4 Drawing Sheets

(58) Field of Classification Search
CPC .... H01P 1/222; H01P 1/00; H01P 3/12; H01P 3/122; H01P 3/127; H01P 3/00
See application file for complete search history.

(56) References Cited

U.S. PATENT DOCUMENTS

| | | | | |
|---|---|---|---|---|
| 3,496,497 | A | 2/1970 | Conning | |
| 6,255,920 | B1 | 7/2001 | Ohwada et al. | |
| 9,166,266 | B1 | 10/2015 | Liu | |
| 2003/0112101 | A1* | 6/2003 | Tsunoda | H01P 1/202 333/206 |
| 2006/0082426 | A1 | 4/2006 | Lo Hine Tong et al. | |
| 2010/0127801 | A1* | 5/2010 | Adkins | H01P 1/202 333/206 |
| 2015/0214616 | A1 | 7/2015 | Rogers et al. | |
| 2021/0044024 | A1* | 2/2021 | Deleniv | H01Q 13/06 |

OTHER PUBLICATIONS

Indian Office Action dated Jun. 22, 2021 for Patent Application No. 202017047403, consisting of 5-pages.
International Search Report dated Jan. 23, 2019 for International Application No. PCT/EP2018/061936 filed on May 8, 2018, consisting of 11-pages.
Chi Wang et al; Dual-Mode Conductor-Loaded Cavity Filters; IEEE Transactions on Microwave Theory and Techniques; Aug. 8, 1997, pp. 1240-1246; vol. 45 No. 8; IEEE; Plenum, USA; consisting of 7-pages.

* cited by examiner

WAVEGUIDE SECTION COMPRISING WAVEGUIDE TUBES WITH PLUG-IN FILTER DEVICES

CROSS-REFERENCE TO RELATED APPLICATIONS

This application is a Submission Under 35 U.S.C. § 371 for U.S. National Stage Patent Application of International Application Number: PCT/EP2018/061936, filed May 8, 2018 entitled "A WAVEGUIDE SECTION COMPRISING WAVEGUIDE TUBES WITH PLUG-IN FILTER DEVICES," the entirety of which is incorporated herein by reference.

TECHNICAL FIELD

The present disclosure relates to a waveguide section comprising at least one waveguide tube with a plug-in filter device, used for transmission and reception of radio frequency signals, and also to antenna arrays and the plug-in filter device itself, as well as to methods related to the plug-in antenna device.

BACKGROUND

Antenna elements are devices configured to emit and/or to receive electromagnetic signals such as radfrequency (RF) signals used for wireless communication. Phased antenna arrays are antennas comprising a plurality of antenna elements, by which an antenna radiation pattern can be controlled by changing relative phases and amplitudes of signals fed to the different antenna elements.

Practical implementation of signal filtering functions for such antenna elements is a challenging task. High Q-factor, multiple resonators and high precision are required to achieve filters with low loss and strong suppression of frequencies near the operation band where interference or leakage of radfrequency (RF) power may occur. Microstrip and slot resonators are sometimes used to construct filters for antenna elements. However, low Q-factor of the microstrip or slot resonators cause an increased level of insertion loss. Also, traditional filters are typically designed as if they were isolated, which leads to a reduction of the antenna element bandwidth and a modification of the suppression characteristic due to interaction with the antenna.

Cost is important when designing antenna elements for use in antenna arrays. Since antenna arrays may comprise hundreds of antenna elements, individual antenna element cost significantly contributes to the total cost of producing the antenna array.

Integration and assembly aspects must also be considered. It is for example difficult to fit separate filters in the form of SMT-components (pick—and place and reflow soldering), since there is no place to put them with antennas on one side of a circuit board and active circuits on the other side.

Consequently, there is a need for improved filter arrangements for possible use with antenna elements.

SUMMARY

An object of the present disclosure is to provide improved filter arrangements for possible use with antenna elements.

This object is achieved by means of a waveguide section comprising at least one air-filled waveguide conducting tube having an electrically conducting inner wall. For each waveguide conducting tube, the waveguide section comprises a plug-in filter device that comprises two or more electrically conducting elements arranged in series and spaced apart by a connecting arrangement. Each plug-in filter device is adapted to be retained in the corresponding waveguide conducting tube by means of a dielectric holding arrangement such that the electrically conducting elements are spaced apart from the waveguide conducting tube. The electrically conducting elements are arranged to be electromagnetically coupled such that a radfrequency signal passing via a corresponding waveguide conducting tube is arranged to be electromagnetically filtered.

This enables an uncomplicated filter structure that is easily and reliably applicable for large waveguide arrays. The absence of irises leads to an uncomplicated filter structure.

According to some aspects, the dielectric holding arrangement comprises one or more separate dielectric holders for each plug-in filter device, where each dielectric holder is fitted between a part of the plug-in filter device and the inner wall.

This enables a reliable fixation for each plug-in filter device.

According to some aspects, the electrically conducting elements are positioned between the dielectric holders. Preferably, each waveguide conducting tube comprises a first end portion and a second end portion, where there is a dielectric holder positioned at a respective end portion.

This enables a reliable fixation for each plug-in filter device.

According to some aspects, the dielectric holding arrangement comprises a dielectric layer placed on top of a second end of the waveguide section, which dielectric layer (79) in turn comprises an aperture for each plug-in filter device, where each aperture is adapted to engage a corresponding plug-in filter device.

This enables an uncomplicated filter structure that is easily and reliably applicable for large waveguide arrays.

According to some aspects, each plug-in filter device is adapted to be attached to a PCB, printed circuit board, at a first end of the waveguide section, opposite the second end.

This enables a reliable fixation for each plug-in filter device.

According to some aspects, the connecting arrangement comprises separate connecting members.

This enables a versatile manufacture of each plug-in filter device.

According to some aspects, the connecting members are made in a dielectric material.

This results in that the connecting members have a relatively small influence of the filter characteristics.

According to some aspects, each plug-in filter device is made as one integral piece.

This enables an uncomplicated manufacture of each plug-in filter device.

According to some aspects, each electrically conducting element comprises a plurality of ridges that extend radially towards the inner wall, for example four ridges, where the ridges according to some aspects extend from the connecting arrangement.

According to some aspects, each electrically conducting element has a cylindrical shape.

This enables each plug-in filter device to have a rotational-symmetric shape.

According to some aspects, the plug-in filter device comprises at least two electrically conducting elements having different diameters.

According to some aspects, each waveguide conducting tube comprises an antenna aperture that is arranged to interface with a transmission medium for transmission and reception of RF, radfrequency, waveforms.

According to some aspects, a radfrequency signal comprised in a radfrequency band passing to or from each antenna aperture via the corresponding waveguide conducting tube is arranged to be electromagnetically filtered.

According to some aspects, for each plug-in filter device, a top-most electrically conducting element that is adapted to be positioned closest to the antenna aperture when mounted is arranged as an antenna element.

This confers an advantage of providing an antenna device with an integrated filter, enabling a relatively low insertion loss. The filter and antenna is combined and co-designed, such that at least one of the resonances of the antenna is used as a resonator in the filter.

According to some aspects, for each waveguide conducting tube with a plug-in filter device, the antenna element is arranged at a certain distance from the antenna aperture.

There are also disclosed herein an array antenna arrangement, a method, and a plug-in filter device which are associated with the above-mentioned advantages.

BRIEF DESCRIPTION OF THE DRAWINGS

Further objects, features, and advantages of the present disclosure will appear from the following detailed description, wherein some aspects of the disclosure will be described in more detail with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
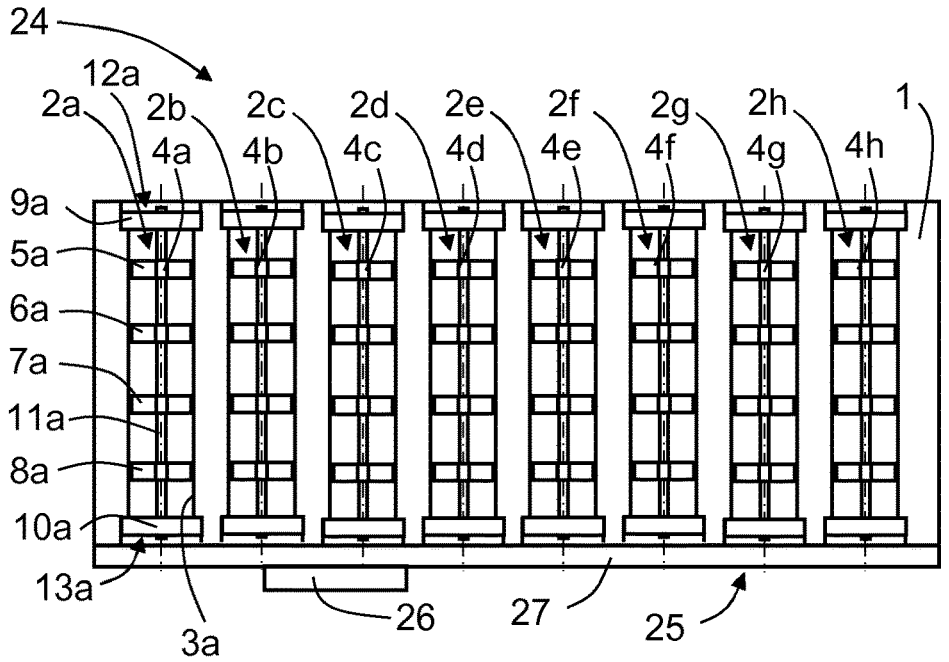
FIG. 1 shows a schematical cut-open side view of a waveguide section with plug-in filter devices mounted and with a dielectric holding arrangement that comprises dielectric holders.
Figure 2:
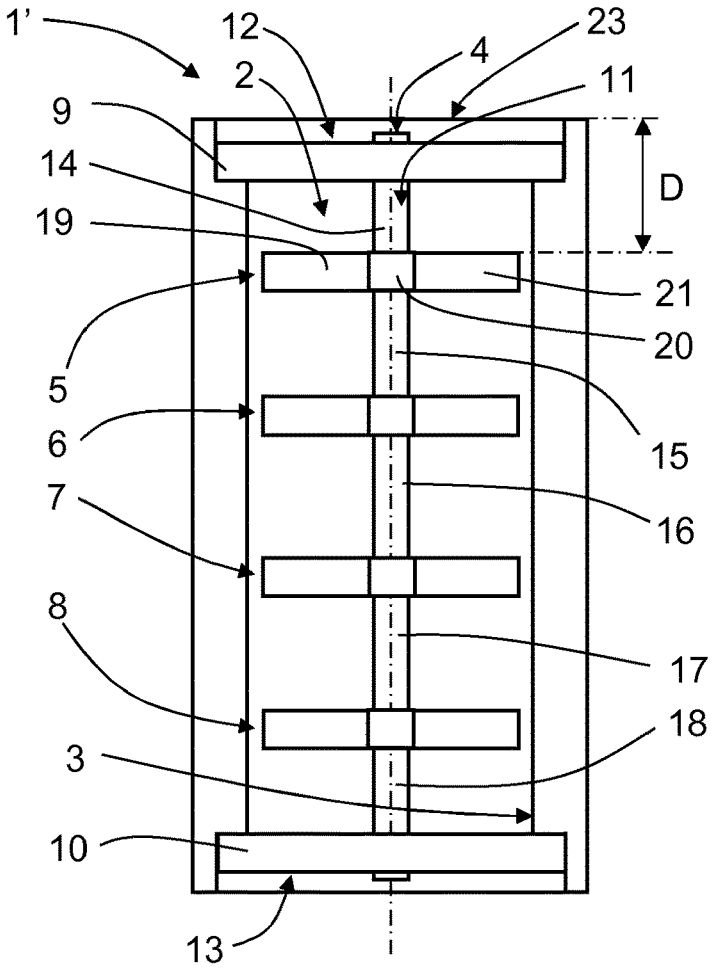
FIG. 2 shows a schematical cut-open side view of a waveguide tube.
Figure 3:
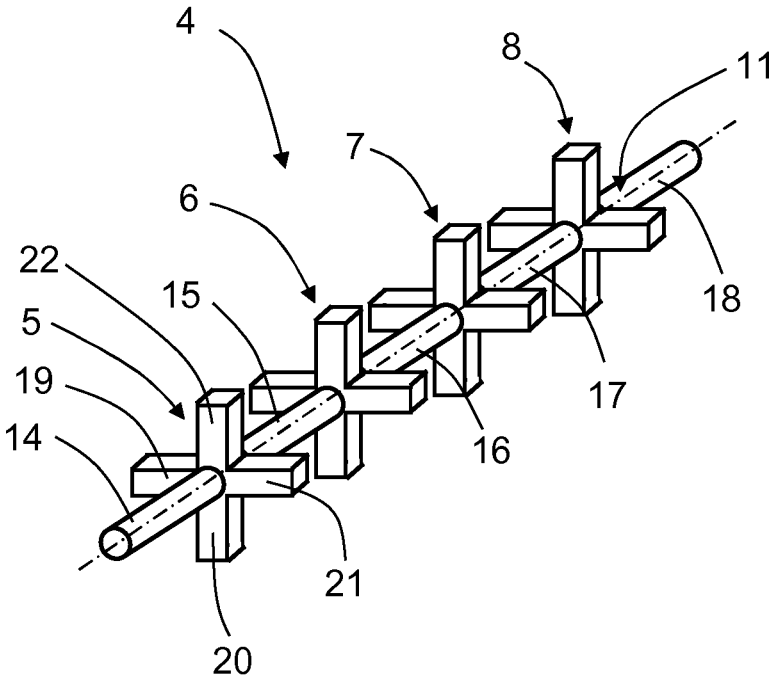
FIG. 3 shows a schematical perspective view of a first example of a plug-in filter device.

With reference to FIG. 1 there is a waveguide section 1 comprising eight air-filled waveguide conducting tubes 2*a*, 2*b*, 2*c*, 2*d*, 2*e*, 2*f*, 2*g*, 2*h*. With reference also to FIG. 2 that shows a cut-open side view of one such waveguide conducting tube 2, each waveguide conducting tube 2; 2*a*, 2*b*, 2*c*, 2*d*, 2*e*, 2*f*, 2*g*, 2*h* has an electrically conducting inner wall 3, 3*a*. For each waveguide conducting tube 2; 2*a*, 2*b*, 2*c*, 2*d*, 2*e*, 2*f*, 2*g*, 2*h*, the waveguide section 1 comprising a plug-in filter device 4, 4*a*, 4*b*, 4*c*, 4*d*, 4*e*, 4*f*, 4*g*, 4*h* that comprises one or more electrically conducting elements 5, 6, 7, 8; 5*a*, 6*a*, 7*a*, 8*a* (only indicated for one plug-in filter device in FIG. 1 for reasons of clarity) arranged in series and spaced apart by a connecting arrangement 11, 11*a*, where a perspective view of one such plug-in filter device 4 is shown in FIG. 3, to which reference also is made.

According to the present disclosure, each plug-in filter device 4, 4*a*, 4*b*, 4*c*, 4*d*, 4*e*, 4*f*, 4*g*, 4*h* is adapted to be retained in the corresponding waveguide conducting tube 2; 2*a*, 2*b*, 2*c*, 2*d*, 2*e*, 2*f*, 2*g*, 2*h* by means of dielectric holders 9, 10; 9*a*, 10*a* such that the electrically conducting elements 5, 6, 7, 8; 5*a*, 6*a*, 7*a*, 8*a* are spaced apart from the waveguide conducting tube 2; 2*a*, 2*b*, 2*c*, 2*d*, 2*e*, 2*f*, 2*g*, 2*h*. This means that there is no contact between the electrically conducting elements 5, 6, 7, 8; 5*a*, 6*a*, 7*a*, 8*a* and a corresponding waveguide conducting tube 2; 2*a*, 2*b*, 2*c*, 2*d*, 2*e*, 2*f*, 2*g*, 2*h*, and according to some aspects there is no contact between any part of the plug-in filter device 4, 4*a*, 4*b*, 4*c*, 4*d*, 4*e*, 4*f*, 4*g*, 4*h* and the corresponding waveguide conducting tube 2; 2*a*, 2*b*, 2*c*, 2*d*, 2*e*, 2*f*, 2*g*, 2*h*.

The electrically conducting elements 5, 6, 7, 8; 5*a*, 6*a*, 7*a*, 8*a* are arranged to be electromagnetically coupled such that a radfrequency signal passing via a corresponding waveguide conducting tube 2; 2*a*, 2*b*, 2*c*, 2*d*, 2*e*, 2*f*, 2*g*, 2*h* is arranged to be electromagnetically filtered.

Each dielectric holder 9, 10; 9*a*, 10*a* is preferably fitted between a part of the plug-in filter device 4, 4*a*, 4*b*, 4*c*, 4*d*, 4*e*, 4*f*, 4*g*, 4*h* and the inner wall 3, 3*a*, and the electrically conducting elements 5, 6, 7, 8; 5*a*, 6*a*, 7*a*, 8*a* are according to some aspects positioned between the dielectric holders 9, 10; 9*a*, 10*a*.

According to some aspects, each waveguide conducting tube 2; 2*a*, 2*b*, 2*c*, 2*d*, 2*e*, 2*f*, 2*g*, 2*h* comprises a first end portion 12, 12*a* and a second end portion 13, 13*a*, where there is a dielectric holder 9, 10; 9*a*, 10*a* positioned at a respective end portion 12, 12*a*; 13, 13*a*; a first dielectric holder 9, 9*a* positioned at the first end portion 12, 12*a* and a second dielectric holder 10, 10*a* positioned at the first second end portion 13, 13*a*.

According to some aspects, the connecting arrangement 11 comprises separate connecting members 14, 15, 16, 17, 18, and according to some further aspects, the connecting members 14, 15, 16, 17, 18 are made in a dielectric material.

It is, alternatively, possible that the connecting members 14, 15, 16, 17, 18 are made in an electrically conducting material, and, according to some aspects, each plug-in filter device 4, 4*a*, 4*b*, 4*c*, 4*d*, 4*e*, 4*f*, 4*g*, 4*h* is made as one integral piece.

As particularly shown in FIG. 3, according to a first example, each plug-in filter device 4 comprises electrically conducting elements 5, 6, 7, 8 which each comprises a plurality of ridges 19, 20, 21, 22 that extend radially towards the inner wall 3 when the plug-in filter device 4 is mounted, according to some aspects there are four symmetrically arranged ridges 19, 20, 21, 22 that form a cross-shape. According to some aspects, the ridges 19, 20, 21, 22 extend from the connecting arrangement 11.

This plug-in filter device 4 thus comprises number of quad-ridge waveguide sections separated by cut off, non-propagating, sections. This design enables a higher order TE11 mode to propagate in a quad-ridged coaxial waveguide. Since this is a degenerate mode with two polarization states, two orthogonal polarities will be will be accommodated.

There are two modes of operation this plug-in filter device 4 can be designed for. The first mode uses quad-ridged section with electrical length close to halve-wavelength. Alternatively, height of the ridges can be increased which leads to reduced length of the resonator. Then the edge effects will become a dominating factor and a spurious free window, the spacing to next higher order mode, is considerably increased.

Another problem while designing this kind of filters is due to presence of the dominant coaxial waveguide TEM mode. This mode is not radiating, and with a properly designed feed circuit it should not be excited. However, due non-ideal, lossy, materials and violations in structure symmetries, the coupling between orthogonal modes is unavoidable, i.e. there is power exchange between useful the TE mode and the fundamental TEM coaxial mode. If the resonance of TEM falls within the filter and/or antenna passband for each waveguide conducting tubes with a corresponding plug-in filter device, this will lead to a sharp absorption peak in a transmitted/radiated signal.

The waveguide section 1 according to the present disclosure allows a relative large degree of flexibility in counteracting undesired TEM resonances within the filter and/or antenna passband.

Figure 4:
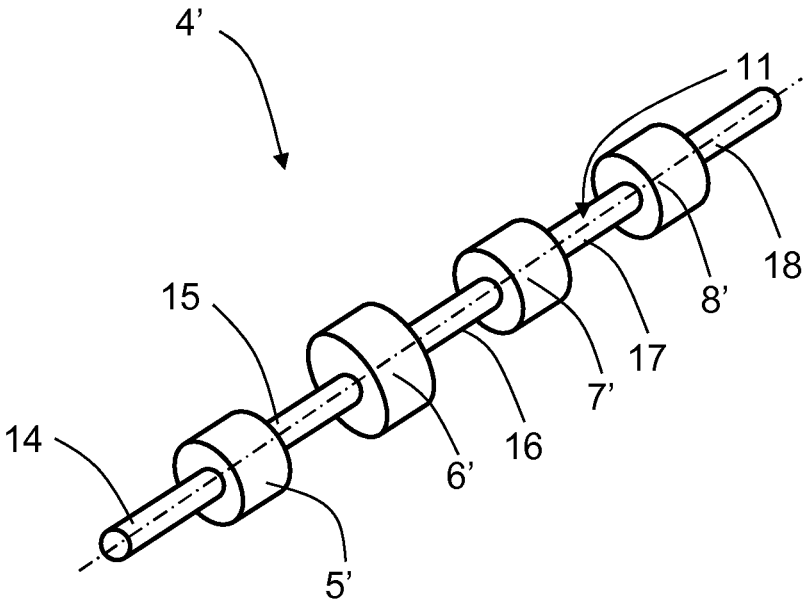
FIG. 4 shows a schematical perspective view of a second example of a plug-in filter device.

As particularly shown in FIG. 4, according to a second example, each plug-in filter device 4' comprises electrically conducting elements 5', 6', 7', 8' which each has a cylindrical shape. According to some aspects, each plug-in filter device 4' comprises at least two electrically conducting elements 5', 6' which each has different diameters.

This plug-in filter device 4 thus comprises a number of waveguide sections, where propagating sections are separated by below cut-off sections. This design utilizes higher order (TE11) mode propagating in a coaxial waveguide. Since this is a degenerate mode, with two polarization states, two orthogonal polarities will be will be accommodated.

As particularly shown in FIG. 2, according to some aspects, each waveguide conducting tube 2 comprises an antenna aperture 23 that is arranged to interface with a transmission medium for transmission and reception of RF, radfrequency, waveforms. Suitably, a radfrequency signal comprised in a radfrequency band passing to or from each antenna aperture 23 via the corresponding waveguide conducting tube 2 is arranged to be electromagnetically filtered.

According to some aspects, for each mounted plug-in filter device 4, a top-most electrically conducting element 5 that is adapted to be positioned closest to the antenna aperture 23, is arranged as an antenna element. Suitably, the antenna element 5 is arranged at a certain distance D from the antenna aperture 23.

Figure 5:
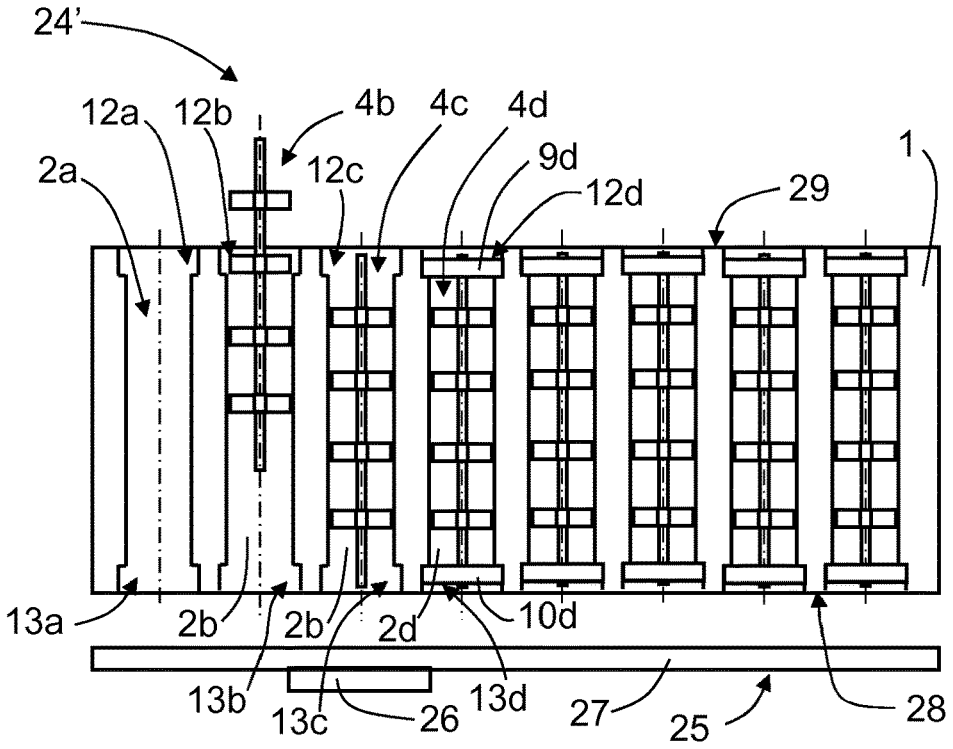
FIG. 5 shows a schematical cut-open side view of a waveguide section with plug-in filter devices mounted and being mounted.

With reference to also to FIG. 5 that shows a schematical cut-open side view of a waveguide section with plug-in filter devices mounted and being mounted, the present disclosure also relates to an array antenna arrangement 24 that comprises a waveguide section 1 with a plurality of waveguide conducting tubes 2*a*, 2*b*, 2*c*, 2*d*, 2*e*, 2*f*, 2*g*, 2*h* with mounted plug-in filter devices 4*a*, 4*b*, 4*c*, 4*d*, 4*e*, 4*f*, 4*g*, 4*h* according to the above.

Each waveguide conducting tube 2*a*, 2*b*, 2*c*, 2*d*, 2*e*, 2*f*, 2*g*, 2*h* comprises an antenna aperture 23. The array antenna arrangement 24 further comprises a feed assembly 25 adapted to feed the waveguide section 1, enabling each waveguide conducting tube 2*a*, 2*b*, 2*c*, 2*d*, 2*e*, 2*f*, 2*g*, 2*h* to interface with an external radfrequency circuit 26.

According to some aspects, the feed assembly 25 comprises a multi-layer printed circuit board 27 (PCB) that is attached to a first end 28 of the waveguide section 1, opposite a second end 29 of the waveguide section, the second end comprising the antenna apertures 23. The array antenna arrangement 24 can be in the form of a linear array antenna arrangement, comprising a row of waveguide conducting tubes 2*a*, 2*b*, 2*c*, 2*d*, 2*e*, 2*f*, 2*g*, 2*h*, or as a 2-dimensional array antenna arrangement comprising several row of waveguide conducting tubes 2*a*, 2*b*, 2*c*, 2*d*, 2*e*, 2*f*, 2*g*, 2*h* so as to form a matrix of waveguide conducting tubes 2*a*, 2*b*, 2*c*, 2*d*, 2*e*, 2*f*, 2*g*, 2*h*.

The waveguide section 1 is according to some aspects formed from a single piece of metal with drilled holes. The holes are shown as circular, but any other shape with 90 degrees rotational symmetry like square, etc. can be used. Alternatively, a metallized plastic can be used as alternative material choice for the waveguide section 1. From production perspective, using casting/molding is possible. The plug-in filter devices can all be the same or can alternatively differ between different waveguide conducting tubes.

With properly chosen material and design for the using dielectric holders 9, 10; 9*a*, 10*a*, their effect on the filter and/or antenna performance is minimized. Also, since dielectric holders 9, 10; 9*a*, 10*a* are not a part of a resonator, the requirement for loss tangent are also quite relaxed, hence many possible materials can considered for use.

Figure 6:
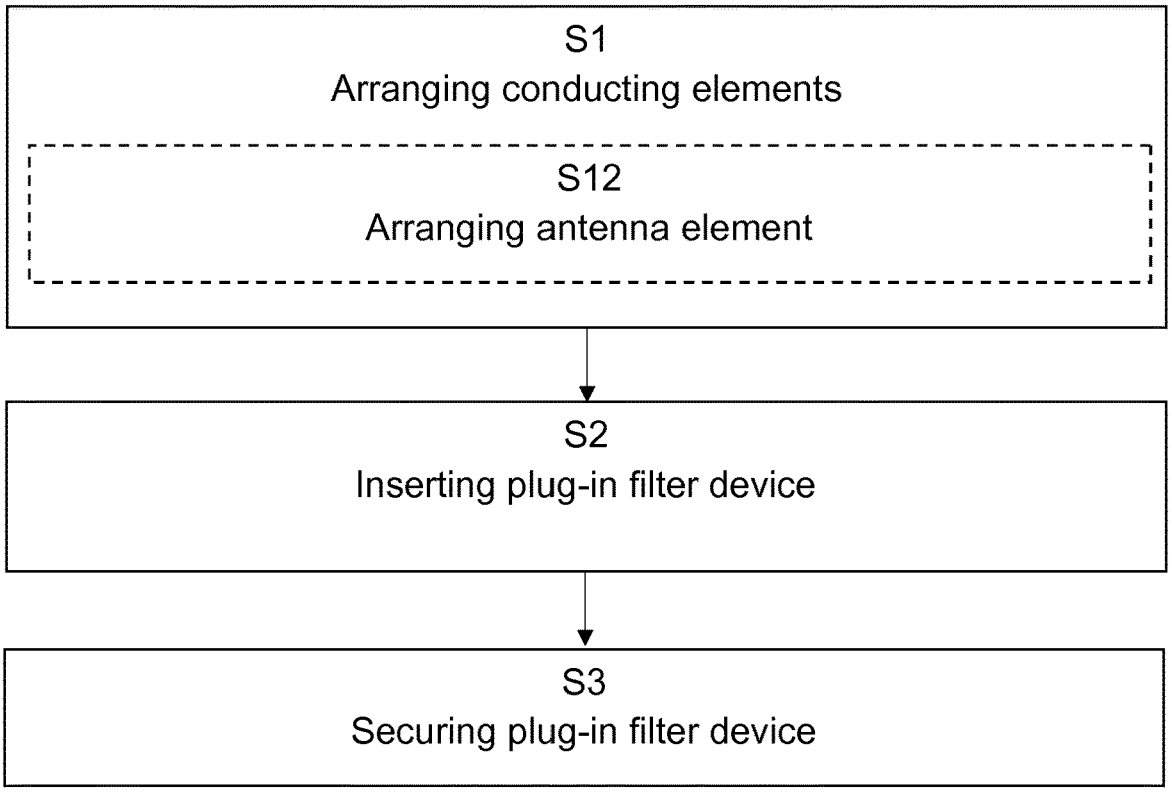
FIG. 6 shows a flowchart schematically illustrating methods according to embodiments.

With reference to FIG. 6, the present disclosure also relates to a method of configuring a waveguide section 1 comprising at least one air-filled waveguide conducting tube 2; 2*a*, 2*b*, 2*c*, 2*d*, 2*e*, 2*f*, 2*g*, 2*h*, wherein, for each air-filled waveguide conducting tube 2; 2*a*, 2*b*, 2*c*, 2*d*, 2*e*, 2*f*, 2*g*, 2*h*, the method comprises:

arranging S1 one or more electrically conducting elements 5, 6, 7, 8; 5*a*, 6*a*, 7*a*, 8*a* in series and spaced apart by a connecting arrangement 11, 11*a* so as to form a plug-in filter device 4; 4*a*, 4*b*, 4*c*, 4*d*, 4*e*, 4*f*, 4*g*, 4*h*;

inserting S2 the plug-in filter device 4; 4*a*, 4*b*, 4*c*, 4*d*, 4*e*, 4*f*, 4*g*, 4*h* in the waveguide conducting tube 2; 2*a*, 2*b*, 2*c*, 2*d*, 2*e*, 2*f*, 2*g*, 2*h*;

securing S3 the plug-in filter device 4; 4*a*, 4*b*, 4*c*, 4*d*, 4*e*, 4*f*, 4*g*, 4*h* in the waveguide conducting tube 2; 2*a*, 2*b*, 2*c*, 2*d*, 2*e*, 2*f*, 2*g*, 2*h* using dielectric holders 9, 10; 9*a*, 10*a* such that the electrically conducting elements 5, 6, 7, 8; 5*a*, 6*a*, 7*a*, 8*a* are spaced apart from the waveguide conducting tube 2; 2*a*, 2*b*, 2*c*, 2*d*, 2*e*, 2*f*, 2*g*, 2*h*, where, when the plug-in filter device 4; 4*a*, 4*b*, 4*c*, 4*d*, 4*e*, 4*f*, 4*g*, 4*h* is received and secured in the waveguide conducting tube 2; 2*a*, 2*b*, 2*c*, 2*d*, 2*e*, 2*f*, 2*g*, 2*h*, the electrically conducting elements 5, 6, 7, 8; 5*a*, 6*a*, 7*a*, 8*a* are electromagnetically coupled, whereby a radfrequency signal passing via the waveguide conducting tube 2; 2*a*, 2*b*, 2*c*, 2*d*, 2*e*, 2*f*, 2*g*, 2*h* is arranged to be electromagnetically filtered.

According to some aspects, the arranging S1 comprises arranging S12 a top-most dielectric element 5 as an antenna element.

The waveguide section 1 according to the present disclosure has a performance that mostly is defined by the precision of the inner conductor part. This is believed to be very essential for production reliability since all potential issues (lamination, metallization, drilling of via holes, etc.) and connected accuracy considerations present in more complex structures are avoided. A wide spurious-free stop band can be achieved.

Figure 7A:
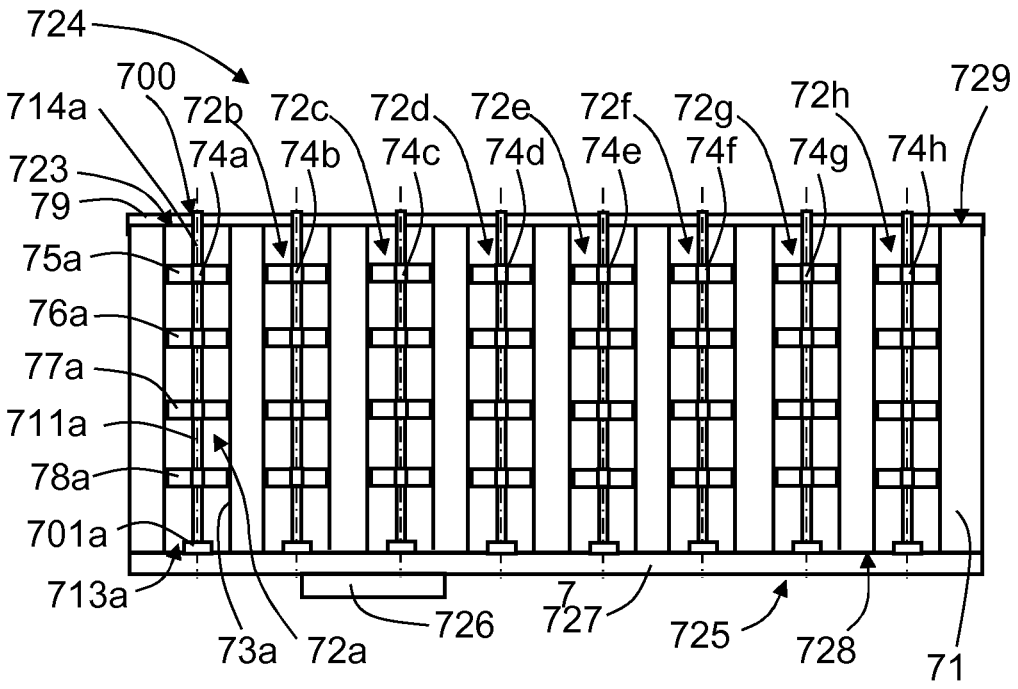
FIG. 7A shows a schematical cut-open side view of a waveguide section with plug-in filter devices mounted and with a dielectric holding arrangement that comprises a dielectric layer.

With reference to FIG. 7A, an alternative array antenna arrangement 724 that in a similar manner as described previously with reference to FIG. 1 comprises a waveguide section 71 with a plurality of waveguide conducting tubes 72*a*, 72*b*, 72*c*, 72*d*, 72*e*, 72*f*, 72*g*, 72*h* with mounted plug-in filter devices 74*a*, 74*b*, 74*c*, 74*d*, 74*e*, 74*f*, 74*g*, 74*h* according to the above. Each waveguide conducting tube 72*a*, 72*b*, 72*c*, 72*d*, 72*e*, 72*f*, 72*g*, 72*h* comprises an antenna aperture 723. As in FIG. 1, only one waveguide conducting tube 72*a* with corresponding filter device 74*a* is fully denoted with reference number for reasons of clarity.

The array antenna arrangement 724 further comprises a feed assembly 725 adapted to feed the waveguide section 71, enabling each waveguide conducting tube 72*a*, 72*b*, 72*c*, 72*d*, 72*e*, 72*f*, 72*g*, 72*h* to interface with an external radfrequency circuit 726.

According to some aspects, the feed assembly 725 comprises a multi-layer printed circuit board 727 (PCB) that is attached to a first end 728 of the waveguide section 71, opposite a second end 729 of the waveguide section, the second end 729 comprising the antenna apertures 723.

Figure 7B:
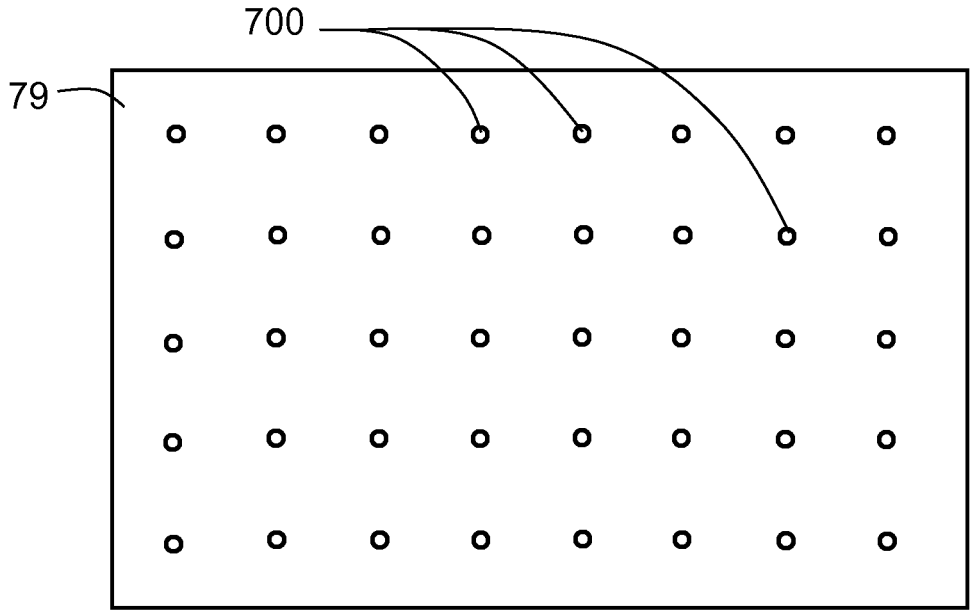
FIG. 7B shows a top view of a dielectric layer.

Here, according to some aspects, all the plug-in filter devices 74*a*, 74*b*, 74*c*, 74*d*, 74*e*, 74*f*, 74*g*, 74*h* are held in place by means of a dielectric layer 79 that is placed on top of the second end 729. The dielectric layer 79 comprises a plurality of apertures 700 as also shown in FIG. 7B for a dielectric layer 79 intended for a two-dimensional 8×5 array antenna (only a few apertures denoted with reference number for reasons of clarity). Each aperture 700 is designed and positioned to hold the corresponding plug-in filter device 74*a*, 74*b*, 74*c*, 74*d*, 74*e*, 74*f*, 74*g*, 74*h* in a correct position by engaging a corresponding connecting member 14*a*. At the first end 728, each plug-in filter device 74*a*, 74*b*, 74*c*, 74*d*, 74*e*, 74*f*, 74*g*, 74*h* is attached to the PCB 727, for example by means of gluing or soldering. For this purpose, according to some aspects, each plug-in filter device 74*a*, 74*b*, 74*c*, 74*d*, 74*e*, 74*f*, 74*g*, 74*h* comprises a corresponding fastening body 701*a*.

The present disclosure is not limited to the above examples, but may vary freely within the scope of the appended claims. For example, each waveguide conducting tube 2*a*, 2*b*, 2*c*, 2*d*, 2*e*, 2*f*, 2*g*, 2*h* with a mounted plug-in filter device 4*a*, 4*b*, 4*c*, 4*d*, 4*e*, 4*f*, 4*g*, 4*h* according to the above is arranged to transmit and/or to receive two different radio frequency signals via two different ports.

According to some aspects, the dielectric holders 9, 10 or dielectric layer 79 are made in any suitable low-loss dielectric material.

According to some aspects, there may be any number of consecutively arranged electrically conducting elements, but at least two.

The waveguide section 1 comprises at least one air-filled waveguide conducting tube 2; 2*a*, 2*b*, 2*c*, 2*d*, 2*e*, 2*f*, 2*g*, 2*h*.

Generally, the present disclosure relates to a waveguide section 1 comprising at least one air-filled waveguide conducting tube 2; 2*a*, 2*b*, 2*c*, 2*d*, 2*e*, 2*f*, 2*g*, 2*h* having an electrically conducting inner wall 3, 3*a*, where, for each waveguide conducting tube 2; 2*a*, 2*b*, 2*c*, 2*d*, 2*e*, 2*f*, 2*g*, 2*h*, the waveguide section 1 comprises a plug-in filter device 4, 4*a*, 4*b*, 4*c*, 4*d*, 4*e*, 4*f*, 4*g*, 4*h* that comprises two or more electrically conducting elements 5, 6, 7, 8; 5*a*, 6*a*, 7*a*, 8*a* arranged in series and spaced apart by a connecting arrangement 11, 11*a*, wherein each plug-in filter device 4, 4*a*, 4*b*, 4*c*, 4*d*, 4*e*, 4*f*, 4*g*, 4*h* is adapted to be retained in the corresponding waveguide conducting tube 2; 2*a*, 2*b*, 2*c*, 2*d*, 2*e*, 2*f*, 2*g*, 2*h* by means of a dielectric holding arrangement 9, 10; 9*a*, 10*a*; 79 such that the electrically conducting elements 5, 6, 7, 8; 5*a*, 6*a*, 7*a*, 8*a* are spaced apart from the waveguide conducting tube 2; 2*a*, 2*b*, 2*c*, 2*d*, 2*e*, 2*f*, 2*g*, 2*h*, where the electrically conducting elements 5, 6, 7, 8; 5*a*, 6*a*, 7*a*, 8*a* are arranged to be electromagnetically coupled such that a radfrequency signal passing via a corresponding waveguide conducting tube 2; 2*a*, 2*b*, 2*c*, 2*d*, 2*e*, 2*f*, 2*g*, 2*h* is arranged to be electromagnetically filtered.

According to some aspects, the dielectric holding arrangement comprises one or more separate dielectric holders 9, 10; 9*a*, 10*a* for each plug-in filter device 4, 4*a*, 4*b*, 4*c*, 4*d*, 4*e*, 4*f*, 4*g*, 4*h*, where each dielectric holder 9, 10; 9*a*, 10*a* is fitted between a part of the plug-in filter device 4, 4*a*, 4*b*, 4*c*, 4*d*, 4*e*, 4*f*, 4*g*, 4*h* and the inner wall 3, 3*a*.

According to some aspects, the electrically conducting elements 5, 6, 7, 8; 5*a*, 6*a*, 7*a*, 8*a* are positioned between the dielectric holders 9, 10; 9*a*, 10*a*.

According to some aspects, each waveguide conducting tube 2; 2*a*, 2*b*, 2*c*, 2*d*, 2*e*, 2*f*, 2*g*, 2*h* comprises a first end portion 12, 12*a* and a second end portion 13, 13*a*, where there is a dielectric holder 9, 10; 9*a*, 10*a* positioned at a respective end portion 12, 12*a*; 13, 13*a*.

According to some aspects, the dielectric holding arrangement comprises a dielectric layer 79 placed on top of a second end 729 of the waveguide section 71, which dielectric layer 79 in turn comprises an aperture for each plug-in filter device 74*a*, 74*b*, 74*c*, 74*d*, 74*e*, 74*f*, 74*g*, 74*h*, where each aperture is adapted to engage a corresponding plug-in filter device 74*a*, 74*b*, 74*c*, 74*d*, 74*e*, 74*f*, 74*g*, 74*h*.

According to some aspects, each plug-in filter device 74*a*, 74*b*, 74*c*, 74*d*, 74*e*, 74*f*, 74*g*, 74*h* is adapted to be attached to a PCB, printed circuit board, 727, at a first end 728 of the waveguide section 71, opposite the second end 729.

According to some aspects, each plug-in filter device 74*a*, 74*b*, 74*c*, 74*d*, 74*e*, 74*f*, 74*g*, 74*h*, comprises a corresponding fastening body 701*a* adapted to be attached to the PCB 727.

According to some aspects, the connecting arrangement 11 comprises separate connecting members 14, 15, 16, 17, 18.

According to some aspects, the connecting members 14, 15, 16, 17, 18 are made in a dielectric material.

According to some aspects, each plug-in filter device 4, 4*a*, 4*b*, 4*c*, 4*d*, 4*e*, 4*f*, 4*g*, 4*h* is made as one integral piece.

According to some aspects, each electrically conducting element 5, 6, 7, 8 comprises a plurality of ridges 19, 20, 21, 22 that extend radially towards the inner wall 3.

According to some aspects, each electrically conducting element 5, 6, 7, 8 comprises four symmetrically arranged ridges 19, 20, 21, 22 that extend radially towards the inner wall 3.

According to some aspects, the ridges 19, 20, 21, 22 extend from the connecting arrangement 11.

According to some aspects, each electrically conducting element 5', 6', 7', 8' has a cylindrical shape.

According to some aspects, the plug-in filter device 4' comprises at least two electrically conducting elements 5', 6' having different diameters.

According to some aspects, each waveguide conducting tube 2 comprises an antenna aperture 23 that is arranged to interface with a transmission medium for transmission and reception of RF, radfrequency, waveforms.

According to some aspects, a radfrequency signal comprised in a radfrequency band passing to or from each antenna aperture 23 via the corresponding waveguide conducting tube 2 is arranged to be electromagnetically filtered.

According to some aspects, for each plug-in filter device 4, a top-most electrically conducting element 5 that is adapted to be positioned closest to the antenna aperture 23 when mounted is arranged as an antenna element.

According to some aspects, for each waveguide conducting tube 2 with a plug-in filter device 4, the antenna element 5 is arranged at a certain distance D from the antenna aperture 23.

Generally, the present disclosure also relates to an array antenna arrangement 24, comprising a waveguide section 1 according to any one of the claims 16-19, where the waveguide section 1 comprises a plurality of waveguide conducting tubes 2*a*, 2*b*, 2*c*, 2*d*, 2*e*, 2*f*, 2*g*, 2*h* with plug-in filter devices 4*a*, 4*b*, 4*c*, 4*d*, 4*e*, 4*f*, 4*g*, 4*h*, where the array antenna arrangement 24 further comprises a feed assembly 25 adapted to feed the waveguide section 1, enabling each waveguide conducting tube 2*a*, 2*b*, 2*c*, 2*d*, 2*e*, 2*f*, 2*g*, 2*h* to interface with an external radfrequency circuit 26.

According to some aspects, the feed assembly 25 comprises a multi-layer printed circuit board 27, PCB, that is attached to a first end 28 of the waveguide section 1, opposite a second end 29 of the waveguide section, the second end comprising the antenna apertures 23.

Generally, the present disclosure also relates to a plug-in filter device 4, 4*a*, 4*b*, 4*c*, 4*d*, 4*e*, 4*f*, 4*g*, 4*h* arranged to be received in a waveguide conducting tube 2; 2*a*, 2*b*, 2*c*, 2*d*, 2*e*, 2*f*, 2*g*, 2*h* comprised in a waveguide section 1, the plug-in antenna device 4, 4*a*, 4*b*, 4*c*, 4*d*, 4*e*, 4*f*, 4*g*, 4*h* comprising two or more electrically conducting elements 5, 6, 7, 8; 5*a*, 6*a*, 7*a*, 8*a* arranged in series and spaced apart by a connecting arrangement 11, 11*a*, wherein the plug-in filter device 4, 4*a*, 4*b*, 4*c*, 4*d*, 4*e*, 4*f*, 4*g*, 4*h* further comprises a dielectric holding arrangement 9, 10; 9*a*, 10*a*; 79 enabling the plug-in filter device 4, 4*a*, 4*b*, 4*c*, 4*d*, 4*e*, 4*f*, 4*g*, 4*h* to be retained in a waveguide conducting tube 2; 2*a*, 2*b*, 2*c*, 2*d*, 2*e*, 2*f*, 2*g*, 2*h* such that the electrically conducting elements 5, 6, 7, 8; 5*a*, 6*a*, 7*a*, 8*a* are spaced apart from the waveguide conducting tube 2; 2*a*, 2*b*, 2*c*, 2*d*, 2*e*, 2*f*, 2*g*, 2*h*, where the electrically conducting elements 5, 6, 7, 8; 5*a*, 6*a*, 7*a*, 8*a* are arranged to be electromagnetically coupled such that when received in a waveguide conducting tube 2; 2*a*, 2*b*, 2*c*, 2*d*, 2*e*, 2*f*, 2*g*, 2*h*, a radfrequency signal passing via that waveguide conducting tube 2; 2*a*, 2*b*, 2*c*, 2*d*, 2*e*, 2*f*, 2*g*, 2*h* is arranged to be electromagnetically filtered.

According to some aspects, the dielectric holding arrangement comprises one or more separate dielectric holders 9, 10; 9*a*, 10*a* for each plug-in filter device 4, 4*a*, 4*b*, 4*c*, 4*d*, 4*e*, 4*f*, 4*g*, 4*h*, where the electrically conducting elements 5, 6, 7, 8; 5*a*, 6*a*, 7*a*, 8*a* are positioned between the dielectric holders 9, 10; 9*a*, 10*a*.

According to some aspects, each electrically conducting element 5, 6, 7, 8 comprises a plurality of radially extending ridges 19, 20, 21, 22.

According to some aspects, each electrically conducting element (5, 6, 7, 8) comprises four symmetrically arranged radially extending ridges 19, 20, 21, 22.

The invention claimed is:

1. A waveguide section comprising at least one air-filled waveguide conducting tube having an electrically conducting inner wall, where, for each waveguide conducting tube, the waveguide section comprises a plug-in filter device that comprises two or more electrically conducting elements arranged in series and spaced apart by a connecting arrangement, each plug-in filter device being configured to be retained in the corresponding waveguide conducting tube by a dielectric holding arrangement such that the electrically conducting elements are spaced apart from the waveguide conducting tube, the electrically conducting elements are arranged to be electromagnetically coupled such that a radfrequency signal passing via a corresponding waveguide conducting tube is arranged to be electromagnetically filtered, the dielectric holding arrangement comprising a dielectric layer placed on top of a second end of the waveguide section, the dielectric layer in turn having an aperture for each plug-in filter device, each aperture being configured to engage a corresponding plug-in filter device.

2. The waveguide section according to claim 1, wherein each plug-in filter device is configured to be attached to a PCB, printed circuit board, at a first end of the waveguide section, opposite the second end.

3. The waveguide section according to claim 2, wherein each plug-in filter device comprises a corresponding fastening body configured to be attached to the PCB.

4. The waveguide section according to claim 1, wherein the connecting arrangement comprises separate connecting members.

5. The waveguide section according to claim 4, wherein the connecting members are made of a dielectric material.

6. The waveguide section according to claim 1, wherein each plug-in filter device is made as one integral piece.

7. The waveguide section according to claim 1, wherein each electrically conducting element comprises a plurality of ridges that extend radially towards the inner wall.

8. The waveguide section according to claim 7, wherein each electrically conducting element comprises four symmetrically arranged ridges that extend radially towards the inner wall.

9. The waveguide section according to claim 7, wherein the ridges extend from the connecting arrangement.

10. The waveguide section according to claim 1, wherein each electrically conducting element has a cylindrical shape.

11. The waveguide section according to claim 10, wherein the plug-in filter device comprises at least two electrically conducting elements having different diameters.

12. The waveguide section according to claim 1, wherein each waveguide conducting tube comprises an antenna aperture that is arranged to interface with a transmission medium for transmission and reception of radfrequency, RF, waveforms.

13. The waveguide section according to claim 12, wherein a radfrequency signal comprised in a radfrequency band passing to or from each antenna aperture via the corresponding waveguide conducting tube is arranged to be electromagnetically filtered.

14. The waveguide section according to claim 1, wherein the waveguide section is part of an antenna array, the waveguide section having a plurality of waveguide conducting tubes with plug-in filter devices the array antenna having a feed assembly configured to feed the waveguide section, enabling each waveguide conducting tube to interface with an external radio frequency circuit.

15. A method of configuring a waveguide section comprising at least one air-filled waveguide conducting tube, for each air-filled waveguide conducting tube, the method comprises:

arranging one or more electrically conducting elements in series and spaced apart by a connecting arrangement so as to form a plug-in filter device;

inserting the plug-in filter device in the waveguide conducting tube;

securing the plug-in filter device in the waveguide conducting tube using dielectric holders such that the electrically conducting elements are spaced apart from the waveguide conducting tube, where, when the plug-in filter device is received and secured in the waveguide conducting tube, the electrically conducting elements are electromagnetically coupled, such that a radfrequency signal passing via the waveguide conducting tube is electromagnetically filtered, the dielectric holders being comprised in an dielectric holding arrangement, the dielectric holding arrangement having a dielectric layer placed on top of a second end of the waveguide section, the dielectric layer in turn having an aperture for each plug-in filter device, each aperture being configured to engage a corresponding plug-in filter device.

16. A plug-in filter device arranged to be received in a waveguide conducting tube comprised in a waveguide section, the plug-in filter device comprising two or more electrically conducting elements arranged in series and spaced apart by a connecting arrangement, the plug-in filter device further comprising a dielectric holding arrangement enabling the plug-in filter device to be retained in a waveguide conducting tube such that the electrically conducting elements are spaced apart from the waveguide conducting tube, the electrically conducting elements being arranged to be electromagnetically coupled such that when received in a waveguide conducting tube, a radfrequency signal passing via that waveguide conducting tube is electromagnetically filtered, the dielectric holding arrangement having a dielectric layer placed on top of a second end of the waveguide section, the dielectric layer in turn having an aperture for each plug-in filter device, each aperture being configured to engage a corresponding plug-in filter device.

17. The plug-in filter device according to claim 16, wherein each plug-in filter device is made as one integral piece.

18. The plug-in filter device according to claim 16 wherein each electrically conducting element comprises a plurality of radially extending ridges.

19. The plug-in filter device according to claim 18, wherein each electrically conducting element comprises four symmetrically arranged radially extending ridges.

20. The plug-in filter device according to claim 18, wherein the ridges extend from the connecting arrangement.

* * * * *